United States Patent [19]

LaCamera et al.

[11] Patent Number: 5,015,343

[45] Date of Patent: May 14, 1991

[54] ELECTROLYTIC CELL AND PROCESS FOR METAL REDUCTION

[75] Inventors: Alfred F. LaCamera, Trafford; Jan H. L. Van Linden, Allison Park; Thomas V. Pierce, Delmont; James O. Parkhill, Tarentum, all of Pa.

[73] Assignee: Aluminum Company of America, Pittsburgh, Pa.

[21] Appl. No.: 438,500

[22] PCT Filed: Dec. 19, 1988

[86] PCT No.: PCT/US88/04565

§ 371 Date: Aug. 25, 1989

§ 102(e) Date: Aug. 25, 1989

[87] PCT Pub. No.: WO89/06289

PCT Pub. Date: Jul. 13, 1989

Related U.S. Application Data

[63] Continuation-in-part of Ser. No. 138,391, Dec. 28, 1987, abandoned, which is a continuation-in-part of Ser. No. 197,889, May 24, 1988, abandoned.

[51] Int. Cl.[5] ..... C25C 3/06; C25B 1/02; C25B 1/00

[52] U.S. Cl. ..... 204/67; 204/60; 204/61; 204/71

[58] Field of Search ..... 204/60, 61, 64 R, 67, 204/71, 243 R, 245, 280, 294, 284, 292

[56] References Cited

U.S. PATENT DOCUMENTS

| | | | |
|---|---|---|---|
| 4,504,366 | 3/1985 | Jarrett et al. | 204/67 |
| 4,681,671 | 7/1987 | Duruz | 204/67 |
| 4,707,239 | 11/1987 | Murphy et al. | 204/247 |

FOREIGN PATENT DOCUMENTS

| | | |
|---|---|---|
| 0096990 | 12/1983 | European Pat. Off. . |
| 0711177 | 1/1980 | U.S.S.R. . |
| 0908959 | 2/1982 | U.S.S.R. . |

*Primary Examiner*—John F. Niebling
*Assistant Examiner*—Kathryn Gorgos
*Attorney, Agent, or Firm*—Daniel A. Sullivan, Jr.

[57] ABSTRACT

An improved electrolytic cell and process are provided wherein metals and metal alloys are formed from oxides or nitrides in a molten salt, without the evolution of halogen or halogen compounds, with less corrosion and reduced power consumption by the use of an electrode having an extended or substantially increased surface area effective for the evolution of oxygen and carbon oxide, and a molten salt electrolyte effective at low temperature.

56 Claims, 2 Drawing Sheets

ELECTROLYTIC CELL AND PROCESS FOR METAL REDUCTION

CROSS-REFERENCE TO RELATED APPLICATIONS

By way of international application PCT/US88/04565, this is a continuation-in-part of now-abandoned U.S. patent application Nos. 07/138,391 filed Dec. 28, 1987 and 07/197,889 filed May 24, 1988, now abandoned.

DESCRIPTION

1. Technical Field

This invention relates to an electrolytic cell and to the electrolytic formation of an electrode product using a molten salt.

2. Background of Invention

In the electrolytic decomposition of alumina in molten salts, the Hall-Heroult process is commonly employed. Examples of Hall-Heroult cells are shown in U.S. Pat. Nos. 3,839,167, 3,996,117, and 4,269,673.

It has been known that the power consumption can be decreased in a Hall-Heroult cell by placing the anode and cathode in close proximity to one another. However, to maintain typical operating temperatures and gain the energy conserved in a Hall-Heroult cell as a result of reducing anode-cathode distance an equal reduction of thermal losses to the environment is required. The degree of insulation possible to reduce thermal energy lost is limited by the need to maintain a frozen electrolyte layer on the sidewall for protecting the lining materials. An increase in current could be used to achieve normal operating temperature, but this is limited by the magnetic stability of the cell and would reduced the energy conserved.

DISCLOSURE OF INVENTION

This invention enables the use of molten salts with limited reactant, e.g. alumina, solubility to be such as aluminum. An advantage is that some of these salts have low liquidus temperatures, e.g. in the range 300° to 900° C., preferably in the 500° to 800° C., such that the molten salt operating temperature can be lower than usual Hall-Heroult cell operating temperatures, for instance from 900° C. down to the melting point of aluminum (or even below the melting point of aluminum if it is desired to produce solid aluminum). These salts are not as corrosive as those conventionally used in the Hall-Heroult process, are lower in density, and have lower alkali metal activity. The reduced corrosion eliminates the need for frozen electrolyte to protect the materials used in cell construction. The lower density of the salt improves cell stability because of the greater density difference between the metal and the salt, requiring greater force differences to create the same amplitude waves at the bath-metal interface. The lower alkali metal activity improves current efficiency, and eliminates swelling of carbon materials in the cell, enhancing cell life. The invention additionally provides the potential for the use of graphitic cathodic floors, rather than the usual carbon floors; graphitic floors are currently not feasible, because of high intercalation of alkali metal species into them, leading to premature failure.

Thus, it is proposed that improved results can be achieved with the use of an electrolytic cell, e.g. a Hall-Heroult cell, comprising an electrode having an evolution of the desired electrode product, and a molten salt with limited reactant solubility. According to the invention, reactant solubility is ≦1 wt %. This allows the use of all broader ranges of molten salt, at lower operating temperatures with benefits in both physical properties and lessened chemical reactivity of the molten salt with cell components such as the materials of construction (for instance the refractories used for the sidewalls and the floor) and the electrodes.

In a preferred embodiment, the anode and cathode are in close proximity to one another, i.e. 0.25"-1.25", and the outside walls of the cell are thermally insulated sufficiently to maintain the electrolyte temperature at the decreased power levels. Operation can be without a frozen sidewall; some suspended solid reactant will usually be present.

Percentages herein are on a weight basis, unless indicated otherwise. Reactant concentrations are based on total weight of molten salt plus reactant, although such is not an essential point in view of the low reactant concentrations.

The invention comprises an improvement concerning the electrolytic decomposition of a substance in a molten salt electrolyte, e.g., a chloride and/or fluoride electrolyte, which typically has low solubility for an oxide whose decomposition is desired. According to the invention, an electrode is employed having an extended or substantially increased surface area effective for the electrolysis of the desired reactant, e.g. alumina, and the evolution of a desired electrode product, such as oxygen and/or carbon oxides rather than halogen or halogen compounds, such as $C_xF_y$ (e.g. $CF_4$).

The use of an extended surface area anode, for instance, results in selective electrolysis of a metal oxide at low concentrations in an electrolyte. For example, the use of an anode with a plurality of holes or channels to increase the surface area was found to decompose aluminum oxide (alumina) in preference to chloride electrolyte in which it was contained. The smaller the hole size the larger the extended surface area can become, improving the effectiveness of the electrode. However, it is necessary for the species of interest to gain access to the depth of the electrode by electrochemical migration and/or convection. The size of the hole channel for gas evolving electrodes should be large enough to avoid gas bubbles blocking the electrical flow of current or providing a path of high resistance. It is desirable to circulate the electrolyte to provide a means of suspending solid reactant and improving its dissolution. Our means of accomplishing this is through an appropriately designed gas and/or magnetically induced electrolyte flow field within the cell. A means of achieving this is to allow the gas to move upwardly through holes or channels, in order to use the buoyancy of the gas to pump the electrolyte. This action is promoted by providing a return channel to create a flow loop. Therefore, adequate hole size and flow control geometry should be provided to achieve this effect. U.S. Pat. No. 3,822,195 utilizes gas-lift pumping to circulate molten salt. The gas-lift pumping can be coupled with magnetically driven flow to enhance the overall effectiveness.

An important feature of the invention is that despite low reactant solubility nevertheless appreciable current densities are achieved. With respect to current density at the anode(s), superficial anode current densities greater than 1, 2, 3, 4, and even 5 or 6 amperes/square inch (0.15, 0.3, 0.45, 0.6,and even 0.75 or 0.9 amperes/- square centimeter) are achieved. Superficial anode current density is determined by dividing the cell current by the cross sectional area of the bottom of the anode assuming there are no holes or channels in it. This area is referred to herein as the "superficial area".

MODES FOR CARRYING OUT THE INVENTION

Figure 1:
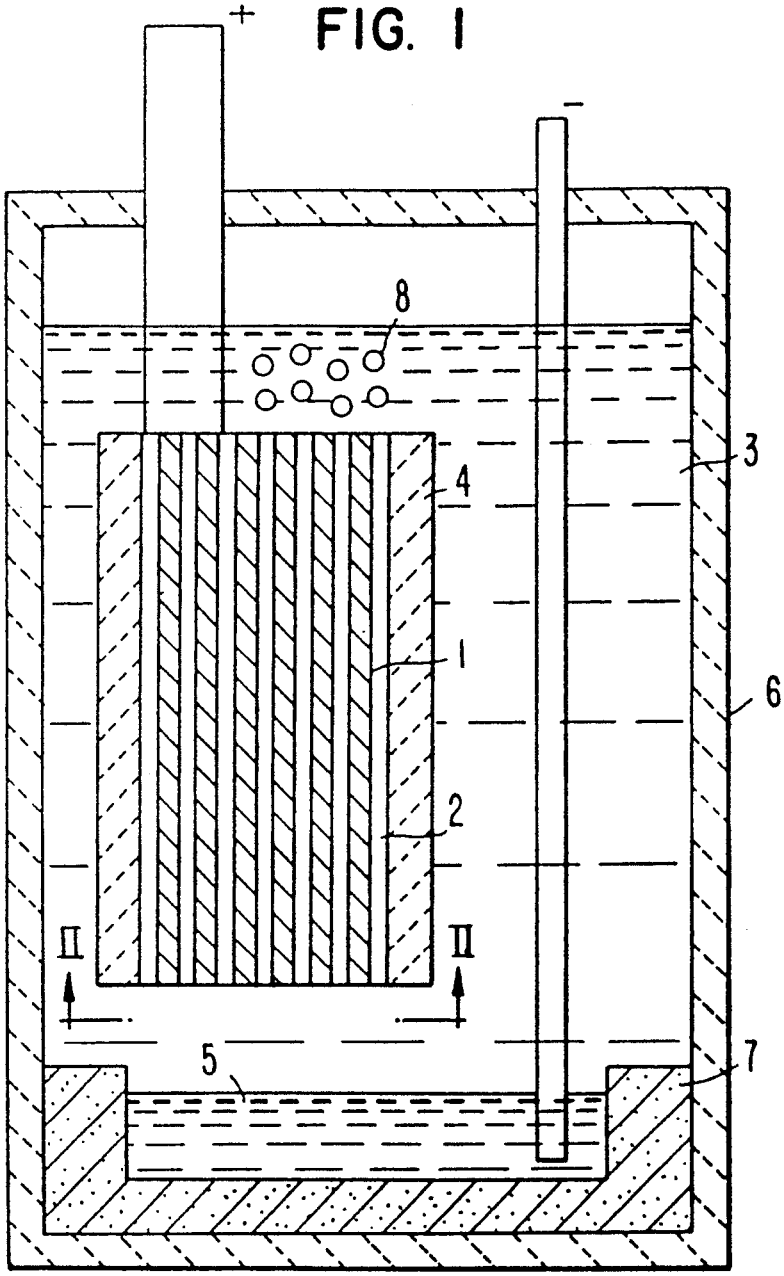
FIG. 1 is a side view of a laboratory electrolytic cell.
Figure 2:
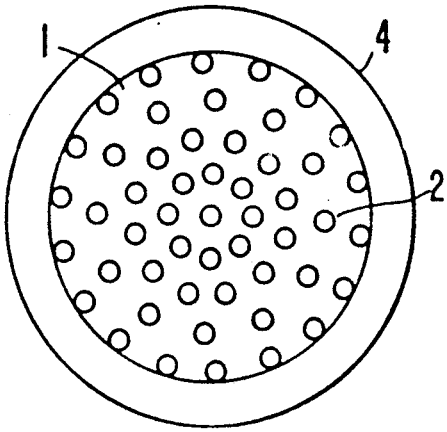
FIG. 2 is a cross sectional view along the cutting plane II—II of FIG. 1.

Referring now to FIGS. 1 and 2 of the drawing, 1 is a cylindrical anode, 2 is one of the channels in the anode, 3 is molten salt, and 5 is a molten metal cathode. The perimeter of the anode, for test purposes, is shielded with a non-conductor 4 to prevent this area from taking part in the electrochemical reaction. The anode is suspended in a quartz vessel 6, and 7 is a graphite liner for the cathode. Gas bubbles 8 are shown rising from the channels 2. Depending on the densities of the molten salt and molten metal, the anode and cathode may be reversed. FIG. 2 shows the end view of the anode illustrating a typical hole pattern drilled into the anode to extend its surface area. A toroidally shaped circulation pattern is set up in the molten salt due to the gas-lift action of the bubbles 8 rising in the channels 2, with the salt rising in the channels and then falling down the outer sides of non-conductor 4, thence to sweep across the upper surface of the cathode 5, and again up through the channels. This circulation acts to suspend undissolved alumina particles and to incorporate into the molten salt the replenishment alumina particles as such is fed from the top of the cell into the molten salt.

Figure 3:
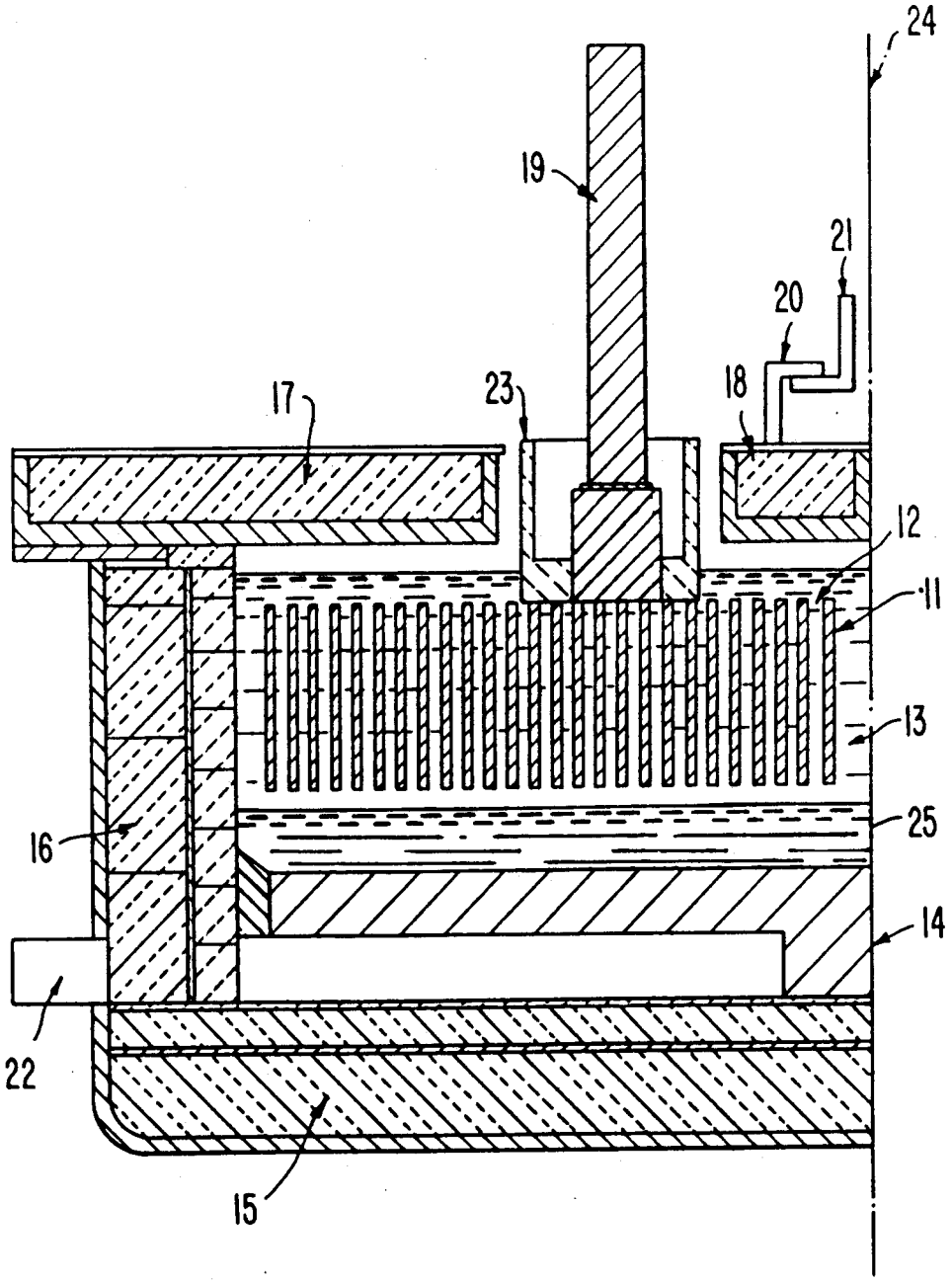
FIG. 3 is an end view of half of a production cell with a vertical cutting plane through an anode for showing internal structure of the anode.

FIG. 3 shows the half of a production cell left of centerline 24, where 11 is an anode, 12 is one of the channels in the anode, 13 is the molten salt bath, and 14 is a carbonaceous, electrically conductive floor. Molten metal (e.g. aluminum) cathode 25 rests on floor 14. Insulation is provided by bottom lining 15, sidewall 16 and lid 17,18. Rod 19 is an anode collector bar for providing d.c. electrical current to the anode 11. The cell lid is attached to a superstructure 21 via elbow 20 and rests on the sidewall 16. Current is removed from the cell through cathode collector bar 22. Sleeve 23 protects the connection between the anode collector bar and the anode from molten salt. A larger anode can be employed, because there is no frozen electrolyte to interfere with its positioning. Depending on the relative densities of the molten salt and molten metal, the anode and cathode may be reversed. The circulation pattern executed by the molten salt in the cell of FIG. 3 will be influenced both by the gas-lift action of the evolved anode product and by electromagnetic phenomena, and the resulting circulation pattern executed by the molten salt will be the result of those combined effects. Electromagnetic effects become more important in production cells because of their large size (e.g. 15-foot by 40-foot rectangular dimensions in the horizontal plane) and the larger electrical current passing through them (e.g. 125 to 150 kiloamperes). For further information on circulation patterns caused by "Hydrodynamic Modeling of Commercial Hall-Heroult Cells" appearing in "Light Metals 1987", pp 269+. The circulation will again act to keep undissolved alumina particles in suspension. Points of addition of replenishment alumina may be chosen based on the molten salt circulation pattern to effect an optimum, rapid incorporation of fed alumina into the molten salt.

The anode configuration is one in which the solid phase is continuous and of relatively high conductivity compared to that of the electrolyte. Consumable anodes and inert anodes may be used. Consumable anodes are made of carbon and react to form carbon dioxide and carbon monoxide, the relative amounts, as is known, being indicative of the current efficiency. An example of inert anode is set forth in U.S. Pat. No. 4,620,905. In 4,620,905, a cermet is provided in which nickel is present as a continuous phase of relatively high conductivity as compared to the ceramic phase. The characteristic feature of inert anodes is that they are not consumed during the electrolysis, so that, in the electrolysis of alumina ($Al_2O_3$), oxygen is evolved as the anode product, rather than carbon oxides as is the case when using carbon anodes.

Suitable molten salt compositions are those which have a limited solubility for alumina. Examples include: about 5 to about 100% metal chlorides (i.e. alkali and alkaline earth metal chlorides, and Group III metal chlorides, e.g., sodium and potassium chlorides, magnesium and calcium chlorides, aluminum chloride, etc.), and about 2 to about 100% metal fluorides (i.e. alkali and alkaline earth metal fluorides, and Group III metal fluorides, e.g., sodium and potassium fluorides, magnesium and calcium fluorides, aluminum fluoride, etc.). The chlorides are, in general, less chemically aggressive than the fluorides. An example of a chloride-based molten salt comprises about 0.5 to about 15 wt. % aluminum chloride, from about 3 to about 40 wt. % of an alkaline earth metal chloride selected from the group consisting of barium, calcium, magnesium, and strontium chloride, from about 10 to 90% lithium chloride and about 10 to 80 wt. % sodium chloride and has a NaCl/LiCl ratio of about 2.33. It is molten at less than about 650° C. This bath is the subject of U.S. Pat. No. 4,440,610.

Suitable fluorides are cryolite ($NA_3AlF_6$), $MgF_2$, $AlF_3$, potassium fluoride and calcium fluoride. An example of a fluoride-based molten salt is formed from about 35 wt. % lithium fluoride, about 45 wt. % magnesium fluoride and about 20 wt. % calcium fluoride. The low temperature operation made possible by this molten salt is indicated by the fact that it has a solidus temperature of approximately 680° C. The weight ratio of NaCl/LiCl or NaCl/KCl is preferably between about 0.25 or 4.

The reactant, e.g. alumina, in the molten salt can be present at a concentration of about 0.1 to about 2%, part of which can be present as undissolved, solid suspension.

Mixtures of chlorides and fluorides may be advantageous, in order to achieve desires physical properties (density, viscosity, etc.) and chemical reactivity.

While the above is illustrative, a number of other anodes and baths may be used. The following examples are preferred embodiments. All parts are by weight unless otherwise specified, as elsewhere in the specification and claims.

EXAMPLE 1

The apparatus used in this example is shown in FIG. 1, except that an anode of rectangular cross section was used. The apparatus was heated by electrical resistance to bring the chloride-base electrolyte in a quartz crucible to a temperature of 740° C. The nominal electrolyte composition was 64 wt. % NaCl, 27 wt. % LiCl, 4 wt. % $AlCl_3$, 5 wt. % $AlF_3$, and 2 wt. % $Al_2O_3$. The alumina in this electrolyte had an estimated solubility less than 0.2 wt. %. The sides of the anode were shielded with boron nitride to eliminate the sides of the anode as electrolysis regions.

In this example, a superficial anode current density of 2.0 amperes/sq. in. was achieved with no measurable chlorine generation (<1.0 ppm). A current efficiency of aluminum production of greater than 80% was measured by $CO_2$ and CO evolution. In this system the carbon anode was prepared by drilling fifty-two, 0.375 in. diameter holes through the six inch length of the anode. The bottom cross section of the anode was 4.5 in. by 3 in., or 13.5 sq. in. The extended area of the anode generated by the holes through the entire length was 360 sq. in. A portion of this extended area will be available for electrolysis depending on the magnitude of the overpotential associated with the electrochemical reaction. In the case of this example, a measure of the change in hole size after electrolysis demonstrated that the hole diameter had increased three inches into the depth of the electrode illustrating electrochemical activity to this depth.

EXAMPLE 2

Using an apparatus as described in Example 1, electrolysis was carried out in an electrolyte composed of 43 wt. % NaCl, 43 wt. % KCl, 12.5 wt. % cryolite and 1.5 wt. % alumina. The estimated alumina solubility was less than 0.6 wt. %. The anode had a 5⅝ in. diameter, was 6 in. long and made of carbon. The perimeter area was electrically insulated with boron nitride as in the previous example. The anode was drilled through its length with one hundred two, 0.375 in. diameter holes. This provided an extended surface area of 721 sq. in. This is approximately 29 times the superficial area of this anode. A superficial current density of 4.2 amperes/sq. in. was achieved with no measurable chlorine generation. Aluminum production current efficiency of greater than 80% was measured by $CO_2$—CO evolution.

EXAMPLE 3

The apparatus described in Example 1 was employed and the electrolysis of MgO was carried out in an electrolyte composed of 69.25 wt. % LiCl, 25 wt. % KCl, 5 wt. % LiF and 0.25% MgO. The electrolysis of MgO was carried out with no measurable chlorine generation at a superficial current density of 2.2 amperes/sq. in. An aluminum pool was used as the cathode to keep the magnesium from floating. Analysis of the aluminum pool at the completion of this experiment resulted in a content of 2.69 wt. % magnesium.

EXAMPLE 4

An extended surface area anode is used in this process the basic design of which is shown in FIGS. 1 and 2. The concept as applied to commercial aluminum production is shown in FIG. 3, where, however, an anode of rectangular cross section is used. A thermal balance is achieved based on the electrical energy used, the aluminum produced, heat losses to the environment, heat of reaction, and an operating temperature of 750° C. The nominal electrolyte composition is 42.75% NaCl, 42.75% KCl, 12.5% $Na_3AlF_6$, and 2% $Al_2O_3$. The alumina in this electrolyte has an estimated solubility less than 0.5%.

In this example, a superficial anode current density of 5/875 amperes/sq. in. at a cell voltage of about 3.22 V is estimated with no expected chlorine generation due to the extended surface area of the anode. The anode-cathode distance is 1.00 in. A current efficiency of aluminum production of about 92% or more is expected. In this system the carbon anode is prepared by drilling 0.375 in. diameter holes through the 15 in height of the anode to achieve a porosity of 30–40%. The bottom cross section of the anode is 21 in. by 39.375 in., or 827 sq. in. The extended area of the anode generated by the holes through the entire height is 46,312 sq. in. A portion of this extended area will be available for electrolysis depending on the magnitude of overpotential associated with the electrochemical reaction. Typically, 1 to 3 inches of the hole depth facing the cathode is electrochemically active. Therefore, increases of 4 to 12 times in surface area for electrolysis are expected. The anode top is submerged below the upper surface of the electrolyte to aid in electrolyte circulation. The connection of the anode rod to the carbon is protected from the electrolyte by a sleeve to protect the salt from getting to the junction between the anode collector bar and the carbon anode. The cell design shown in FIG. 3 takes advantage of the following attributes of the invention: lower temperatures, low reactant-solubility, lower corrosion, greater density difference metal to salt, lower alkali metal activity and higher electrical conductivity. Expected energy required to produce aluminum, based on an energy balance calculation using the 3.22 volts and 92% current efficiency cited above, is only about 4.7 Kwh/lb (kilowatt-hours per pound of aluminum) compared to conventional rates of about 6 or more.

In preferred embodiments, the extended surface area of the electrode is at least about 2 times and more preferably, at least about 15 times that of the superficial area of the electrode. The electrode can be consumable or inert.

We claim:

1. A metal reduction process of electrochemically producing electrode product from metal oxide during electrolysis in a molten salt composition, comprising providing an anode having an extended surface area for the selective evolution of gaseous electrode product, the metal oxide having a solubility <1 wt. % in the molten salt composition.

2. The process of claim 1 wherein the gaseous product comprises oxygen or carbon oxide.

3. The process of claim 1 wherein the anode comprises a plurality of interior holes to increase the surface area of the anode.

4. The process of claim 3 wherein the holes create a 15 to 75% void volume in the anode and extend through the anode.

5. The process of claim 3 wherein the holes are dimensioned to provide gas-lift pumping of the molten salt composition through the channels.

6. The process of claim 1 wherein the extended surface area is at least about 2 times that of the superficial area of the anode.

7. The process of claim 1 wherein the extended surface area is at least about 30 times that of the superficial area of the anode.

8. The process of claim 1 wherein the salt composition comprises metal chlorides or metal fluorides, or both, in the amount of from about 0 to about 100% metal chlorides, 0 to about 100% metal fluorides, and having a liquidus temperature less than about 900° C., and the electrolysis comprises deposition of molten aluminum and evolution of oxygen or carbon oxide as electrode product.

9. The process of claim 1 wherein the salt composition comprises lithium fluoride, magnesium fluoride and calcium fluoride which is molten at less than about 850° C.

10. The process of claim 1 wherein the salt composition comprises sodium chloride, potassium chloride, and cryolite.

11. The process of claim 1 wherein the salt composition comprises about 42.75% sodium chloride, about 42.75% potassium chloride, and about 12.5% cryolite.

12. The process of claim 1 wherein the anode comprises carbon which is consumed during the electrolysis.

13. The process of claim 1 wherein the anode faces a cathode comprising molten metal.

14. The process of claim 1 wherein the electrode product further comprises a metal or metal alloy.

15. The process of claim 1 wherein the anode is consumed during the electrolysis.

16. The process of claim 1 wherein the anode is inert during the electrolysis.

17. A process as claimed in claim 16 wherein said inert anode comprises a cermet material.

18. The process of claim 1 wherein the salt composition contains a fluoride.

19. The process of claim 18 wherein the fluoride comprises cryolite, potassium fluoride or calcium fluoride.

20. The process of claim 1 wherein temperature at a sidewall-molten salt interface is above the liquidus temperature of the molten salt composition, whereby there is no frozen sidewall.

21. The process of claim 1 wherein alumina is present as metal oxide in a concentration range 0.1 to 2%.

22. The process of claim 1 wherein the molten salt composition executes a circulation pattern for suspending and circulating undissolved particles of metal oxide.

23. The process of claim 1 wherein a molten metal cathode rests on a floor of graphitic carbon and the molten metal cathode contains alkali metal constituents.

24. The process of claim 1 wherein superficial anode current density is greater than 1 ampere/square inch.

25. The process of claim 24 wherein superficial anode current density is greater than 2 amperes/square inch.

26. The process of claim 25 wherein superficial anode current density is greater than 3 amperes/square inch.

27. The process of claim 26 wherein superficial anode current density is greater than 4 amperes/square inch.

28. The process of claim 27 wherein superficial anode current density is greater than 5 amperes/square inch.

29. A metal reduction process of electrochemically producing oxygen or carbon oxide anode product from alumina during electrolysis in a molten salt composition, comprising providing an anode having an extended surface area for the selective evolution of such product, the alumina having a solubility $<1$ wt. % in the molten salt composition.

30. A metal reduction process of electrochemically producing electrode product from metal oxide during electrolysis in a molten salt composition, comprising providing an anode having an extended surface area for the selective evolution of a gaseous electrode product, the anode comprises carbon anode, said metal oxide has a concentrated $\leqq 2$ wt. %.

31. A process as claimed in claim 30 wherein said carbon anode is consumed during the electrolysis.

32. The process of claim 30 wherein the gaseous product comprises oxygen or carbon oxide.

33. The process of claim 30 wherein the anode has a plurality of interior holes to increase the surface area of the anode.

34. The process of claim 33 wherein the holes are dimensioned to provide gas-lift pumping of the molten salt composition through the holes.

35. The process of claim 33 wherein the holes create a 15 to 75% void volume in the anode and extend through the anode.

36. The process of claim 30 wherein the extended surface area is at least about 2 times that of the superficial area of the anode.

37. The process of claim 30 wherein the extended surface area is at least about 30 times that of the superficial area of the anode.

38. The process of claim 30 wherein the salt composition comprises metal chlorides or metal fluorides, or both, in the amount of from about 0 to about 100% metal chlorides, 0 to about 100% metal fluorides, and having a liquidus temperature less than about 900° C., and the electrolysis comprises deposition of molten aluminum and evolution of oxygen or carbon oxide as electrode products.

39. The process of claim 30 wherein the salt composition comprises lithium fluoride, magnesium fluoride and calcium fluoride which is molten at less than about 850° C.

40. The process of claim 30 wherein the salt composition comprises sodium chloride, potassium chloride, and cryolite.

41. The process of claim 30 wherein the salt composition comprises about 42.75% sodium chloride, about 42.75% potassium chloride, and about 12.5% cryolite.

42. The process of claim 30 wherein the anode faces a cathode comprising molten metal.

43. The process of claim 30 wherein electrode product further comprises a metal or metal alloy.

44. The process of claim 30 wherein the anode is consumed during the electrolysis.

45. The process of claim 30 wherein the salt composition contains a fluoride.

46. The process of claim 45 wherein the fluoride comprises cryolite, potassium fluoride or calcium fluoride.

47. The process of claim 30 wherein temperature at a sidewall-molten salt interface is above the liquidus temperature of the molten salt composition, whereby there is no frozen sidewall.

48. The process of claim 30 wherein alumina is present as metal oxide in a concentration range 0.1 to 2%.

49. The process of claim 30 wherein the molten salt composition executes a circulation pattern for suspending and circulating undissolved particles of metal oxide.

50. The process of claim 30 wherein a molten metal cathode rests on a floor of graphitic carbon and the molten metal cathode contains alkali metal constituents.

51. The process of claim 30 wherein superficial anode current density is greater than 1 ampere/square inch.

52. The process of claim 51 wherein superficial anode current density is greater than 2 amperes/square inch.

53. The process of claim 52 wherein superficial anode current density is greater than 3 amperes/square inch.

54. The process of claim 53 wherein superficial anode current density is greater than 4 amperes/square inch.

55. The process of claim 54 wherein superficial anode current density is greater than 5 amperes/square inch.

56. A metal reduction process of electrochemically producing electrode product from a metal oxide during electrolysis in a molten salt composition, comprising providing a carbon anode spaced in a chloride-containing molten salt from a cathode, said metal oxide having a solubility $<1$ wt. % in said molten salt composition; the carbon anode having, relative to the cathode, an extended surface area for the evolution of carbon oxide anode product.

* * * * *

UNITED STATES PATENT AND TRADEMARK OFFICE

CERTIFICATE OF CORRECTION

PATENT NO. : 5,015,343

DATED : May 14, 1991

INVENTOR(S) : Alfred F. LaCamera, Jan H. L. Van Linden, Thomas V. Pierce and James O. Parkhill It is certified that error appears in the above-identified patent and that said Letters Patent is hereby corrected as shown below:

| | |
|---|---|
| Col. 1, line 40 | After "to be" insert --used as electrolytes for producing a desired product-- |
| Col. 1, line 67 | After "having an" insert --extended surface area effective for the selective-- |
| Col. 3, line 67 | After "caused by" insert --electromagnetic effects, see Walter E. Wahnsiedler's-- |

Signed and Sealed this

Twenty-second Day of December, 1992

*Attest:*

DOUGLAS B. COMER

*Attesting Officer*

*Acting Commissioner of Patents and Trademarks*